US008876563B2

(12) United States Patent
Onuma et al.

(10) Patent No.: US 8,876,563 B2
(45) **Date of Patent: *Nov. 4, 2014**

(54) CRIMP TERMINAL

(75) Inventors: Masanori Onuma, Makinohara (JP); Kousuke Takemura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/814,122

(22) PCT Filed: Jul. 15, 2011

(86) PCT No.: PCT/JP2011/066211

§ 371 (c)(1),
(2), (4) Date: Feb. 4, 2013

(87) PCT Pub. No.: WO2012/017807

PCT Pub. Date: Feb. 9, 2012

(65) Prior Publication Data

US 2013/0130568 A1 May 23, 2013

(30) Foreign Application Priority Data

Aug. 5, 2010 (JP) ..... 2010-176143

(51) Int. Cl.
*H01R 4/10* (2006.01)
*H01R 4/28* (2006.01)
*H01R 4/18* (2006.01)

(52) U.S. Cl.
CPC *H01R 4/28* (2013.01); *H01R 4/185* (2013.01); *H01R 4/188* (2013.01)
USPC ..... 439/877

(58) Field of Classification Search
CPC ..... H01R 4/184; H01R 4/183; H01R 4/2495; H01R 4/26; H01R 4/185
USPC ..... 439/877, 882
See application file for complete search history.

(56) References Cited

U.S. PATENT DOCUMENTS

| | | | | |
|---|---|---|---|---|
| 8,177,591 | B2 * | 5/2012 | Okamura et al. | 439/877 |
| 2010/0087104 | A1 | 4/2010 | Gump et al. | |
| 2013/0130564 | A1 * | 5/2013 | Onuma et al. | 439/877 |

FOREIGN PATENT DOCUMENTS

| | | | |
|---|---|---|---|
| JP | 55-96575 | A | 7/1980 |
| JP | 5-152011 | A | 6/1993 |
| JP | 2002-141118 | | 5/2002 |
| JP | 2008-305571 | A | 12/2008 |
| JP | 2009-245695 | A | 10/2009 |
| JP | 2010-27463 | A | 2/2010 |

OTHER PUBLICATIONS

Search Report issued from the European Patent Office on Feb. 12, 2014 in European Patent Application 11814437.7.
Official Action issued on Jul. 29, 2014 in Japanese Patent Application 2010-176143.

* cited by examiner

*Primary Examiner* — Phuong Dinh
(74) *Attorney, Agent, or Firm* — Sughrue Mion, PLLC

(57) ABSTRACT

A conductor crimp portion (11) before being crimped to a conductor (Wa) of an electric wire includes, in an inner surface (11R) of the conductor crimp portion (11), circular recesses (20) as serrations of the conductor crimp portion (11) scattered to be spaced from each other. The recesses (20) each has an inner bottom surface (20A) in a form of a hemispherical surface.

2 Claims, 9 Drawing Sheets

CRIMP TERMINAL

This is a national stage entry of International Application No. PCT/JP2011/066211 filed Jul. 15, 2011, which claims the benefit of Application No. JP 2010-176143 filed Aug. 5, 2010, in the Japanese Patent Office (JPO), the disclosures of which are incorporated herein in their entirety by reference.

TECHNICAL FIELD

The present invention relates, for example, to an open barrel type crimp terminal used for an electric system and having a conductor crimp portion having a U-shape cross section.

BACKGROUND ART

FIG. 1 is a perspective view described in, for example PTL 1, and showing a structure of an associated crimp terminal.

A crimp terminal 101 has such a structure that, in the front portion in the longitudinal direction of a terminal (also the longitudinal direction of a conductor of an electric wire to be connected), there is provided an electrical connection portion 110 to be connected to a terminal of a mating connector side, behind the electrical connection portion 110, there is provided a conductor crimp portion 111 to be crimped to an exposed conductor of an end of an electric wire (not shown), and still behind the conductor crimp portion 111, there is provided a coated crimping portion 112 to be crimped to the electric wire's portion coated with an insulative coating. Between the electrical connection portion 110 and the conductor crimp portion 111, there is provided a first connecting portion 113 for connecting the electrical connection portion 110 with the conductor crimp portion 111. Between the conductor crimp portion 111 and the coated crimping portion 112, there is provided a second connecting portion 114 for connecting the conductor crimp portion 111 with the coated crimping portion 112.

The conductor crimp portion 111, which has a bottom plate 111A and a pair of conductor crimping pieces 111B, 111B provided to extend upwardly from right and left side edges of the bottom plate 111A and to be so crimped as to wrap the conductor of the electric wire positioned on an inner surface of the bottom plate 111A, is formed substantially into a U-shape in cross section. The coated crimping portion 112, which has a bottom plate 112A and a pair of coated crimping pieces 112B, 112B provided to extend upwardly from right and left side edges of the bottom plate 112A and to be so crimped as to wrap an electric wire (a portion with an insulative coating) positioned on an inner surface of the bottom plate 112A, is formed substantially into a U-shape in cross section.

The first connecting portion 113 on the front side of the conductor crimp portion 111 and the second connecting portion 114 on the rear side of the conductor crimp portion 111, which respectively have bottom plates 113A, 114A and low side plates 113B, 114B standing upwardly from right and left side edges of the bottom plates 113A, 114A, are each formed substantially into a U-shape in cross section.

A bottom plate in a range from a bottom plate (not shown) of the electrical connection portion 110 in the front portion to the coated crimping portion 112 in the rearmost portion (the bottom plate 113A of the first connecting portion 113, the bottom plate 111A of the conductor crimp portion 111, the bottom plate 114A of the second connecting portion 114, and the bottom plate 112A of the coated crimping portion 112) is formed continuously in a form of one piece of band plate. The front and rear ends of the low side plate 113B of the first connecting portion 113 are continuous with respective lower half portions at a rear end of a side plate (no reference numeral) of the electrical connection portion 110 and at a front end of the conductor crimping piece 111B of the conductor crimp portion 111, while the front and rear ends of the low side plate 114B of the second connecting portion 114 are continuous with respective lower half portions at a rear end of the conductor crimping piece 111B of the conductor crimp portion 111 and at a front end of the coated crimping piece 112B of the coated crimping portion 112.

Of an inner surface 111R and an outer surface 1115 of the conductor crimp portion 111, the inner surface 111R on a side contacting the conductor of the electric wire is provided with a plurality of serrations 120 each in a form of a recess groove extending in a direction perpendicular to a direction in which the conductor of the electric wire extends (longitudinal direction of the terminal).

FIG. 2 is a detail view of the serrations 120 formed at the inner surface of the conductor crimp portion 111, where FIG. 2(*a*) is a plan view showing the developed conductor crimp portion 111 and FIG. 2(*b*) is a cross sectional view taken along the line IIb-IIb in FIG. 2(*a*), and FIG. 2(*c*) is an enlarged view of a portion IIc in FIG. 2(*b*).

The cross sectional configuration of the serration 120 in the form of the recess groove is either rectangular or inverted trapezoidal, where an inner bottom surface 120A is formed substantially parallel to an outer surface 1115 of the conductor crimp portion 111. An inner corner portion 120C where an inner side surface 120B intersects with the inner bottom surface 120A is formed as an angular portion where a plane intersects with a plane. A hole edge 120D where the inner side surface 120B intersects with the inner surface 111R of the conductor crimp portion 111 is formed as an angular edge.

In general, the conductor crimp portion 111 having the above serrations 120 is, as shown in FIG. 3, prepared through a press machining by using a metal mold 200 having protrusion portions 220 (actually, one referred to as serration die assembled to an upper mold of a press metal mold) in positions corresponding to the serrations 120 each in a form of a recess groove.

The metal mold 200 in this case, as shown in FIG. 4, has a protrusion portion 220 which is linear. Therefore, by using a rotary grind stone 250, the metal mold 200 is prepared on an upper surface of a block 210 through a grinding. FIG. 5 shows an external view of the metal mold 200.

For crimping, to the conductor of the end of the electric wire, the conductor crimp portion 111 (of the crimp terminal 101) having the above structure, the crimp terminal 101 is placed on a placing surface (upper surface) of a not-shown lower mold (anvil), then the conductor of the electric wire is inserted between the conductor crimping pieces 111A of the conductor crimp portion 111, and then the conductor of the electric wire is placed on the upper surface of the bottom plate 111A. Then, lowering the upper mold (crimper) relative to the lower mold allows a guide inclined surface of the upper mold to gradually bring down a distal end side of the conductor crimping piece 111B inwardly.

Then, with the upper mold (crimper) further lowered relative to the lower mold, finally, the distal end of the conductor crimping piece 111B is so rounded, with a curved surface continuous from the guide inclined surface to a central mountainous portion of the upper mold, as to be folded back to the conductor side, and the distal ends of the conductor crimping pieces 111B being frictionally mated with each other are made to eat into the conductor, to thereby crimp the conductor crimping piece 111B in such a manner as to wrap the conductor.

The above operations can connect, by the crimping, the conductor crimp portion 111 of the crimp terminal 101 to the conductor of the electric wire. With respect to the coated crimping portion 112 as well, the lower mold and the upper mold are used to gradually bend the coated crimping pieces 112B inwardly, to thereby crimp the coated crimping pieces 112B to the electric wire's portion coated with the insulative coating. By these operations, the crimp terminal 101 can be electrically and mechanically connected to the electric wire.

In the crimp operation by the crimping, an applied pressure force allows the conductor of the electric wire to enter into the serration 120 at the inner surface of the conductor crimp portion 111 while causing a plastic deformation, thus strengthening the joint between the terminal 101 and the electric wire.

CITATION LIST

Patent Literature

Patent Literature 1: Japanese Unexamined Patent Publication No. 2009-245695 (FIG. 1)

SUMMARY OF INVENTION

Incidentally, with respect to the associated crimp terminal 101 set forth above, the inner surface 111R of the conductor crimp portion 111 is provided with the recess groove-shaped serrations 120 intersecting with the direction in which the electric wire extends. However, a sufficient contact conductivity was, as the case may be, not necessarily obtained.

That is, when the conductor crimp portion 111 is crimped to the conductor of the electric wire, the surface of the conductor caused to flow by the pressing force causes a frictional mating with the hole edge of the serration or the surface of the conductor entering into the serration causes a frictional mating with the inner surface of the serration, thereby an oxide film of the surface of the conductor is peeled off and a newly formed surface exposed has a contact conduction with the terminal. In this respect, since being linear, the associated serration 120 showed an effectiveness when the conductor of the electric wire flows in the longitudinal direction. However, the associated serration 120 failed to show an effectiveness when the conductor extends in directions other than the longitudinal direction. Thus, a sufficiently high contact conductivity was, as the case may be, not necessarily obtained.

In the case of using the metal mold prepared by the grinding, a roundness at a distal end peripheral edge of the protrusion portion 220 of the metal mold 200 is likely to be small, thus, as shown in FIGS. 2(*b*), (*c*), such a problem was caused as that the inner corner portion 120C where the inner bottom surface 120A and inner side surface 120B of the serration 120 of the crimp terminal 101 intersect with each other becomes angular. Therefore, the conductor having entered into the serration 120 fails to sufficiently reach as far as the inner corner portion 120C in a state in which the conductor crimp portion is crimped to the conductor of the electric wire, thus making it likely to cause a gap to the inner corner portion 120C. Thus, there was such a fear as that, in the case of a large gap caused between the inner corner portion 120C and the conductor of the electric wire, being influenced by thermal shock, mechanical vibration or the like, the oxide film grows with the gap as a start point to thereby lower the contact conductivity between the conductor and the crimp terminal 101.

When the metal mold prepared by grinding is used, inability of sharpening an outer peripheral edge of the rotary grinding stone for preventing a crack or gradual removal of an edge by a wear according to usage enlarges a roundness at the root of the protrusion portion 220 of the metal mold 200, as a result, a roundness of the hole edge 120D of the serration 120 of the crimp terminal 101 as a work was likely to be large. With the roundness of the hole edge 120D enlarged, a failures becomes likely to be caused in the state after the crimping.

That is, the hole edge 120D of the serration 120 has such an operation as to hold down the conductor, which is about to be deformed in the forward-rearward direction, to thereby make the conductor immovable in the forward-rearward direction, thus promoting the frictional mating between the terminal and the conductor flowing in the serration 120 and the conductor extending in the forward-rearward direction outside the serration 120 so as to improve peeling property of the oxide film. However, when the roundness of the hole edge 120D is enlarged, the operation of the hole edge 120D becomes dull, and the conductor becomes likely to move when receiving the thermal shock or mechanical vibration, as a result, the contact resistance between the terminal and the conductor is increased.

Therefore, the present applicant has developed a crimp terminal where an inner surface of a conductor crimp portion is provided with many small circular recesses, as serrations, spaced apart from each other in such a manner as to be scattered about. It is conceived that the crimp terminal can bring about the following effects.

That is, when the conductor crimp portion is crimped to the conductor of the electric wire by using the crimp terminals, the conductor of the electric wire, while causing a plastic deformation, enters into each of the small circular recesses provided, as the serrations, at the inner surface of the conductor crimp portion, thus enabling to strengthen the joint between the terminals and the conductor. In this case, the surface of the conductor caused to flow by a pressing force has a frictional mating with hole edges of the respective recesses or the surface of the conductor entering into the each of the recesses causes a frictional mating with the inner side surfaces of the recesses, thereby an oxide film of the surface of the conductor is peeled off and a newly formed surface exposed has a contact conduction with the crimp terminals. Especially, since many small circular recesses are provided at the crimp terminals as to be scattered about, irrespective of the extending direction of the conductor, a total length of the hole edges of the recesses brings about an effectiveness in scraping off the oxide film. Thus, the contact conduction effect by the exposure of the newly formed surface can be more increased than when the linear serration intersecting with the direction in which the conductor of the electric wire extends is provided according to the associated example.

In the case of the press machining of the linear serrations, it is necessary to have formed the linear protrusion portions at the press metal mold. Therefore, the machining of the protrusion portions had no choice other than relying on the grinding. However, in the case of making, at the press metal mold, many small circular protrusion portions for machining the serrations, it becomes easy to rely on a machining method other than the grinding. For example, in the case of forming, at the press metal mold, linear protrusion portions, it is necessary to have formed linear recesses at the discharge electrode for making the protrusion portions by the discharge machining. However, as a matter of fact, forming of the linear recesses at the metal block was of difficulty, and therefore was not proper for the discharge machining. However, in the case of making, at the press metal mold, many small circular protrusion portions for machining the serrations, the protrusion portions of the metal mold can be made with ease by the discharge machining and the like. For example, in the case of the discharge machining, only having machined many small circular recesses, by drilling, at the base material block of the electrode can transfer many small circular protrusion portions to the metal mold. Thus, the machining can be facilitated.

The selection of the method of machining the press metal mold can form a pretty large roundness (including chamfer) of a distal end peripheral edge of the protrusion portion (of the metal mold) which corresponds to the small circular recess of the conductor crimp portion and can form a pretty small roundness (including chamfer) of the bottom outer periphery of the protrusion portion of the metal mold. As a result, the roundness of the inner peripheral corner portion of the small circular recess of the conductor crimp portion can be formed pretty large and the roundness of the hole edge of the recess can be formed pretty small, thus enabling to solve the above problems which were likely to be caused in the case of the linear serration.

However, it has become obvious that, even when many small circular recesses are made to be formed as the serrations at the inner surface of the conductor crimp portion, there is still a room for improvement in increasing the contact conductivity between the terminal and the conductor.

For example, it is known that, at the time of crimping of the terminal, when the conductor of the electric wire extends by the press pressure, the terminal also extends simultaneously and that the extension of the terminal is greatly caused mainly to the bottom surface portion of each of the small circular recesses. The above extension is caused because the thickness of the bottom surface portion of the recess is thin. However, when the bottom surface portion of the recess greatly extends, the position of the inner side surface or hole edge of the recess moves accordingly, thus reducing the relative movement amount between the conductor and the terminal caused to flow due to the extension. When the relative movement amount between the conductor and the terminal is reduced, the frictional mating between the conductor and the terminal is made inactive, to thereby the peeling of the oxide film of the conductor surface becomes hardly promoted, thus reducing the contact pressure between the conductor and the hole edge or inner side surface of the recess. Thus, it has become obvious, that due to the above operations, the contact conductivity between the conductor and the terminal is not increased to such an extent as expected.

It is an object of the present invention to provide a crimp terminal capable of further increasing a contact conductivity between a conductor and the crimp terminal.

An aspect of the present invention is a crimp terminal including: an electrical connection portion provided in a front portion in a longitudinal direction of the terminal; and a conductor crimp portion provided behind the electrical connection portion and crimped and connected to a conductor of an end of an electric wire, the conductor crimp portion having a cross section formed into a U-shape by a bottom plate and a pair of conductor crimping pieces provided to extend upwardly from both right and left side edges of the bottom plate and crimped to wrap the conductor disposed on an inner surface of the bottom plate, wherein the conductor crimp portion before being crimped to the conductor of the end of the electric wire includes, in an inner surface of the conductor crimp portion, circular recesses as serrations scattered to be spaced from each other, and wherein the recesses each has an inner bottom surface in a form of a hemispherical surface.

According to the above aspect, the following effects can be obtained.

When the conductor crimp portion is crimped to the conductor of the electric wire by using the crimp terminal, the conductor of the electric wire, while causing a plastic deformation, enters into each of the small circular recesses provided, as the serrations, at the inner surface of the conductor crimp portion, to thereby strengthen the joint between the crimp terminal and the conductor. In this case, the surface of the conductor caused to flow by a pressing force has a frictional mating with hole edges of the respective recesses or the surface of the conductor entering into the each of the recesses causes a frictional mating with the inner side surfaces of the recesses, thereby an oxide film of the surface of the conductor is peeled off and a newly formed surface exposed has a contact conduction with the crimp terminal. Especially, since many small circular recesses are provided, as serrations, at the crimp terminal, irrespective of the extending direction of the conductor, a total length of the hole edges of the respective recesses brings about an effectiveness in scraping off the oxide film. Thus, the contact conduction effect by the exposure of the newly formed surface can be more increased than when the linear serration intersecting with the direction in which the conductor of the electric wire extends is provided like the associated example.

Since the inner bottom surfaces of the small circular recesses each have a hemispherical surface, the conductor having entered into the recess is caused to smoothly flow along the hemispherical surface, thus enabling to reduce the gap caused to the inner corner portion of the serration. There was such a fear as that, in the case of a large gap, being influenced by thermal shock, mechanical vibration or the like, the oxide film grows with the gap as a start point to thereby lower the contact conductivity between the conductor and the crimp terminal. However, capability of reducing the gap can suppress the growth of the oxide film and maintain a good contact conduction performance for a long time.

Since the inner bottom surfaces of the recesses each have a hemispherical surface, the thin portion at the bottom of the recesses can be reduced as much as possible. When the inner bottom surface of the recess 24 has a flat surface, the thin portion becomes large by an amount equivalent to an area of the flat surface, thus the inner bottom surface becomes likely to extend accordingly when the press pressure is applied. However, when the inner bottom surfaces of the recesses each have the hemispherical surface, the thin portion is narrowed down to the one point in the center portion of the hemispherical surface, thus increasing the rigidity from the inner bottom surfaces to the inner side surfaces, to thereby make the bottom of the recesses hardly extendable. Thus, the relative movement amount between the conductor and the recesses extended according to the press pressure is enlarged and the extension of the conductor entering into the recesses is promoted, the frictional mating between the crimp terminal and the conductor is activated and the peeling of the oxide film of the conductor sursurface is promoted. Increasing the rigidity from the inner bottom surfaces to inner side surfaces of the recesses increases the contact pressure between the recesses (especially, the hole edges) and the conductor. As a result, the contact conductivity between the conductor and the crimp terminal is improved.

Further, since the inner bottom surfaces of the recesses each have the hemispherical surface, the stress applied to the distal end of the protrusion portion of the metal mold at the time of the pressing machining of the recesses can be reduced, thus bringing about an advantage of improving the wear resistance of the metal mold.

The recesses each may have an inner peripheral side surface, in a form of a cylindrical surface, connecting an area from a hole edge of the recess to a peripheral edge of the inner bottom surface in the form of the hemispherical surface.

According to the above structure, since the inner peripheral side surface in the form of the cylindrical surface is secured for the recess, the depth from the hole edge of the recess to the inner bottom surface of the recess is enlarged, thus increasing the uniting strength between the conductor (entering into the recess) and the terminal. The contact area between the inner surface of the recess and the conductor is increased, thus increasing the contact conductivity.

DESCRIPTION OF EMBODIMENTS

Hereinafter, embodiments of the present invention will be explained with reference to drawings.

Figure 1:
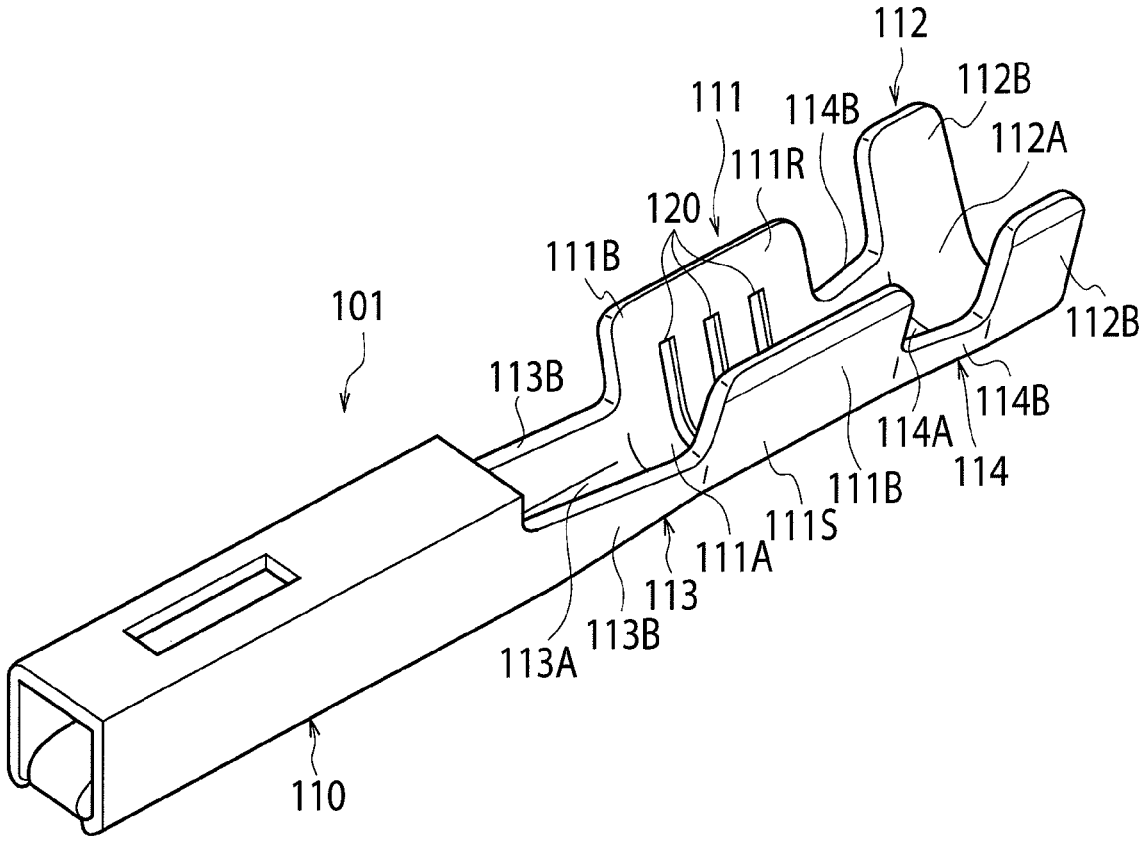
FIG. 1 is a perspective view showing a structure of an associated crimp terminal.
Figure 2:
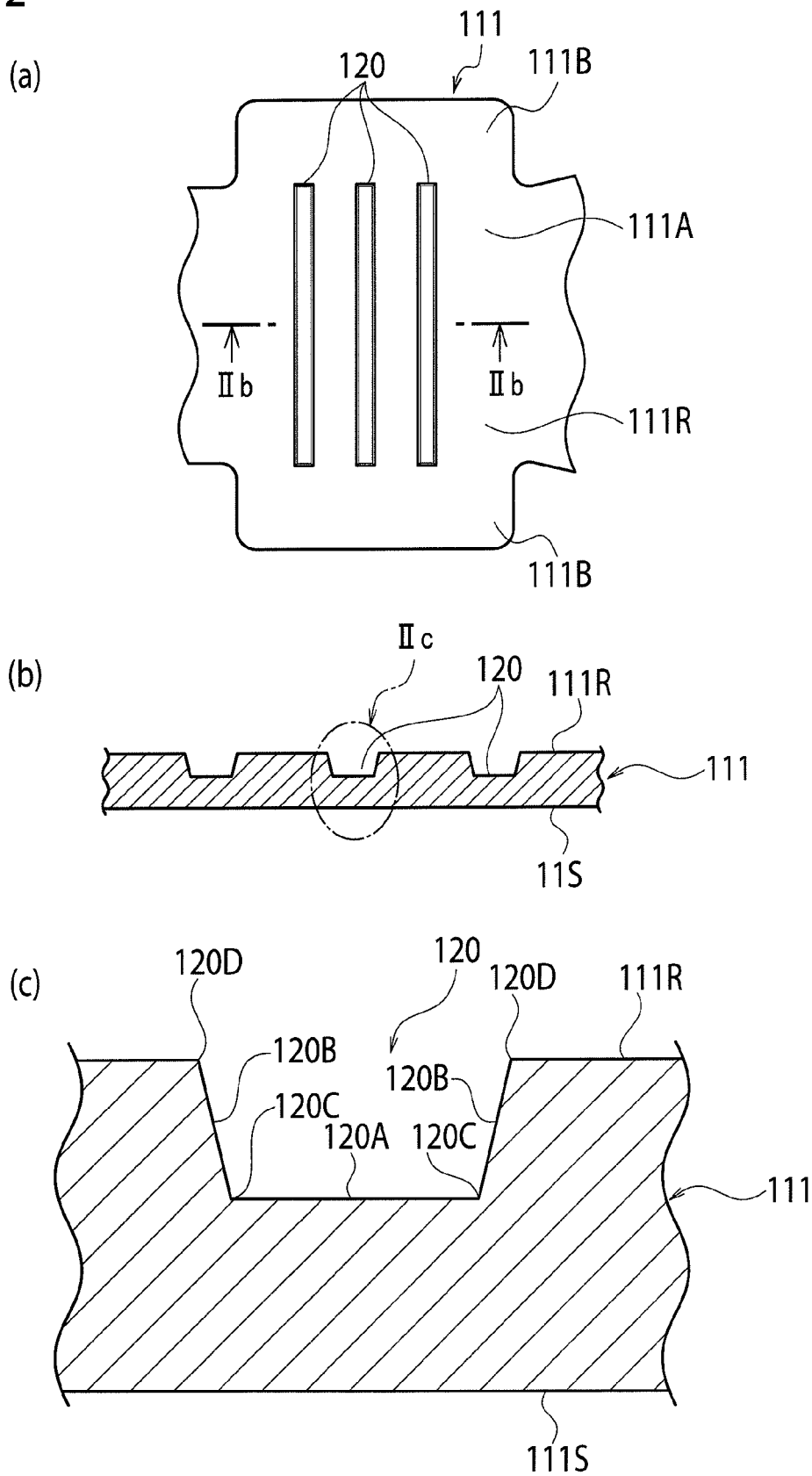
FIG. 2 shows a state before a conductor crimp portion of the crimp terminal is crimped, where (a) is a developed plan view, (b) is across sectional view taken along the line IIb-IIb, and (c) is an enlarged view of a portion IIc in (b).
Figure 3:
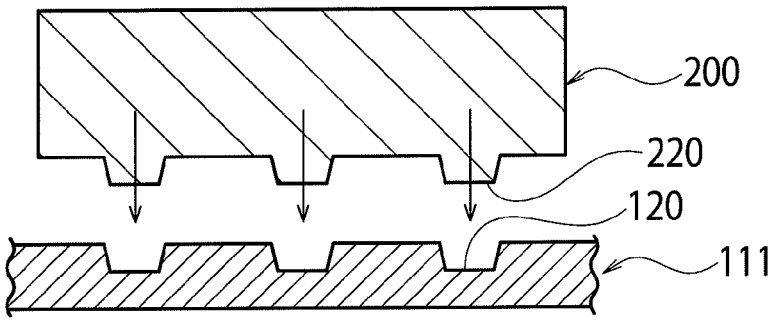
FIG. 3 is a cross sectional view showing a state where a serration of the crimp terminal in FIG. 1 is pressed.
Figure 4:
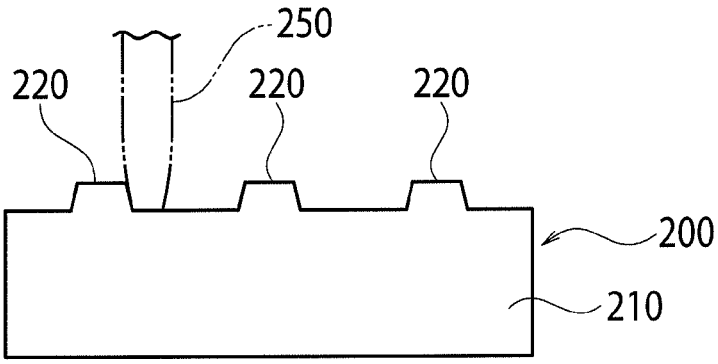
FIG. 4 is a side view showing that a protrusion portion for machining the serration is formed, by grinding, at a press metal mold used for the pressing in FIG. 3.
Figure 5:
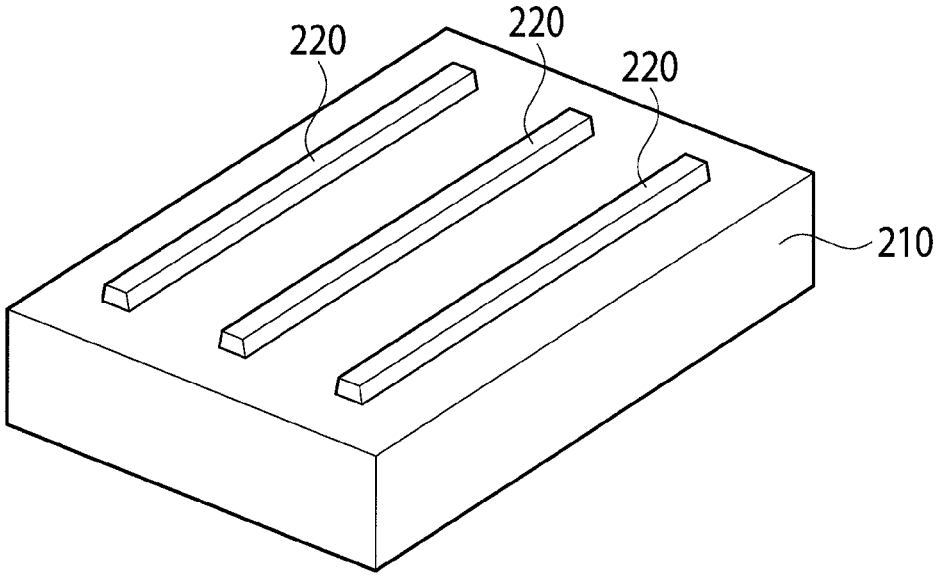
FIG. 5 is an external perspective view of the press metal mold prepared by the machining in FIG. 4.
Figure 6:
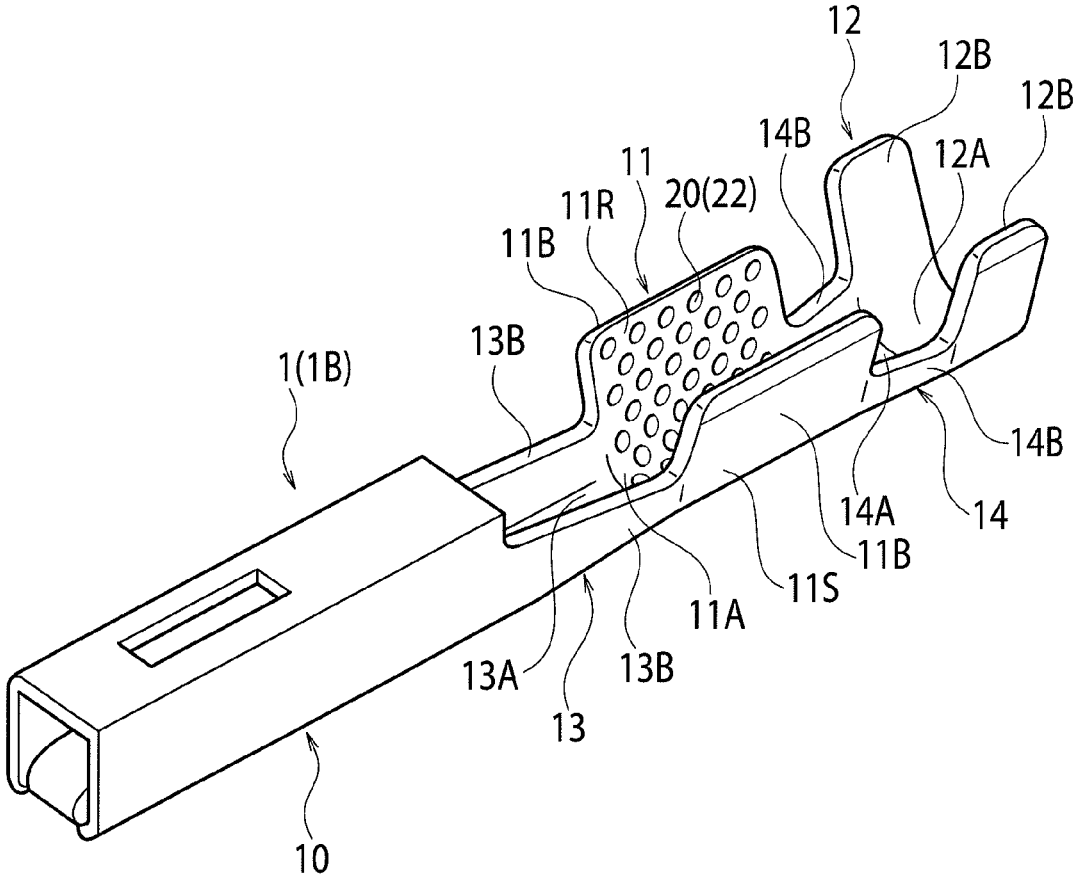
FIG. 6 is a perspective view showing an entire structure common to the crimp terminals according to first and second embodiments of the present invention.
Figure 7:
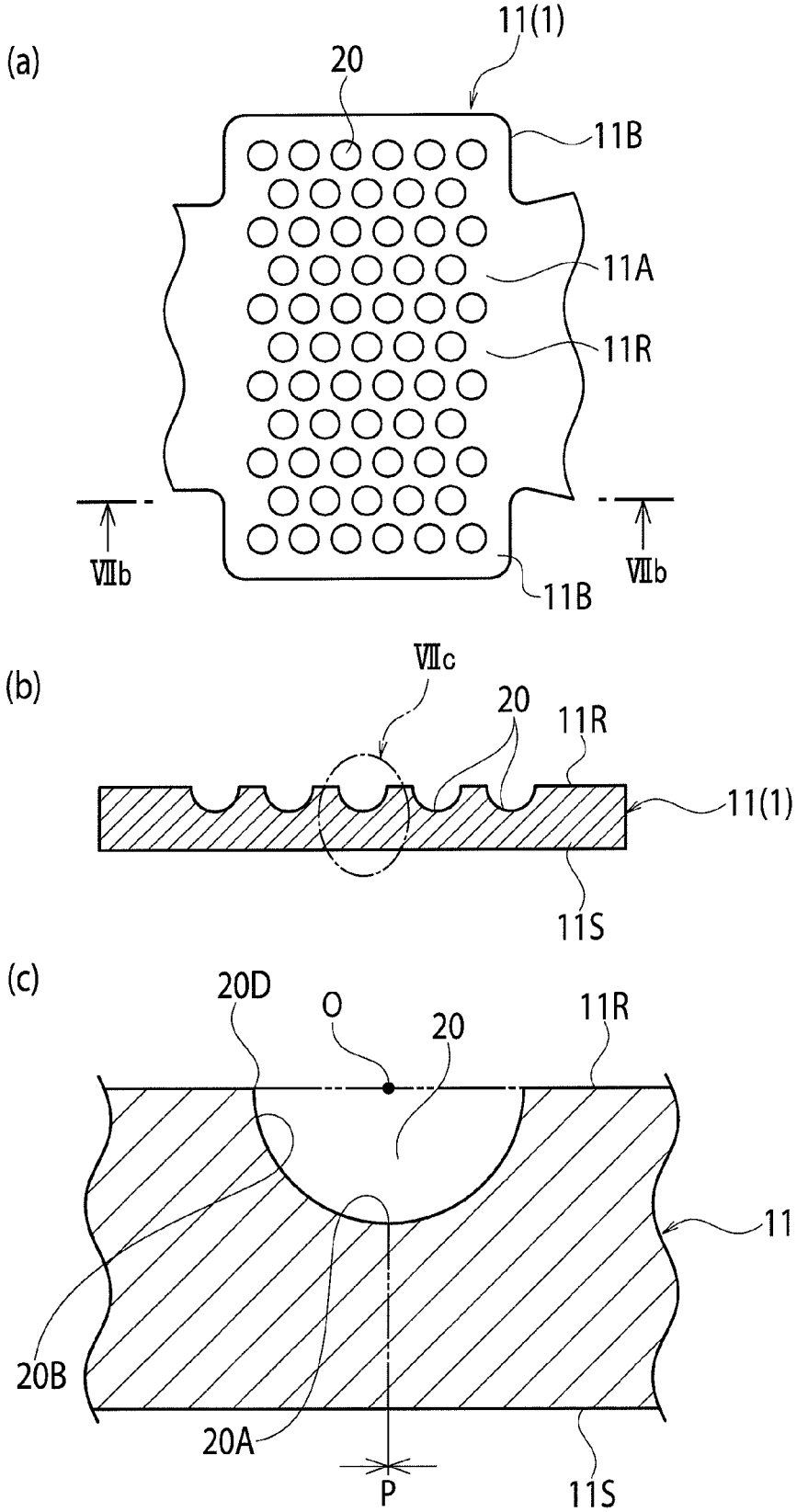
FIG. 7 shows a state before the conductor crimp portion of the crimp terminal is crimped according to the first embodiment of the present invention, where (a) is a developed plan view, (b) is a cross sectional view taken along the line VIIb-VIIb in (a), and (c) is an enlarged view of a portion VIIc in (b).
Figure 8:
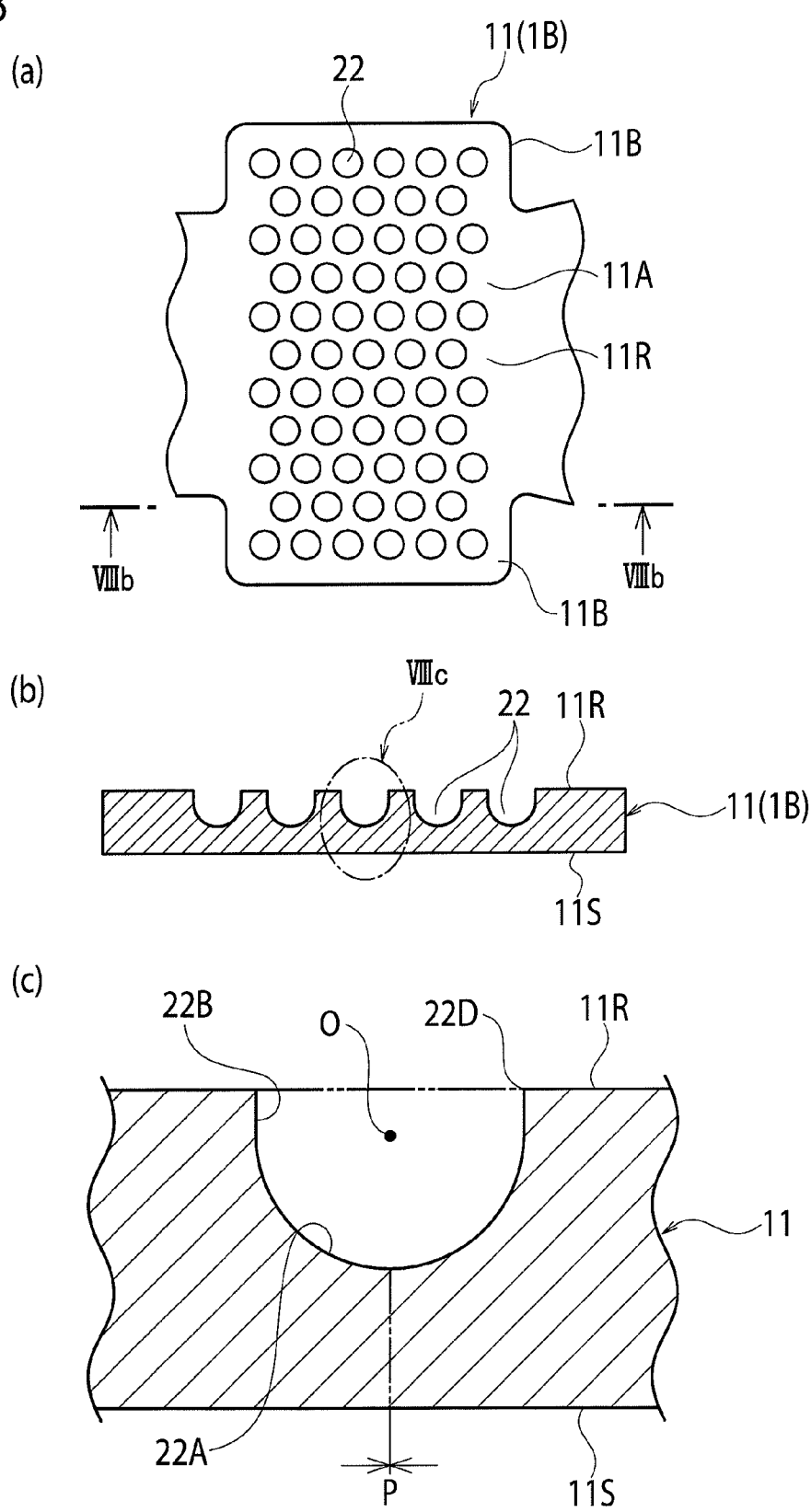
FIG. 8 shows a state before the conductor crimp portion of the crimp terminal is crimped according to the second embodiment of the present invention, where (a) is a developed plan view, (b) is a cross sectional view taken along the line VIIIb-VIIIb in (a), and (c) is an enlarged view of a portion VIIIc in (b).
Figure 9:
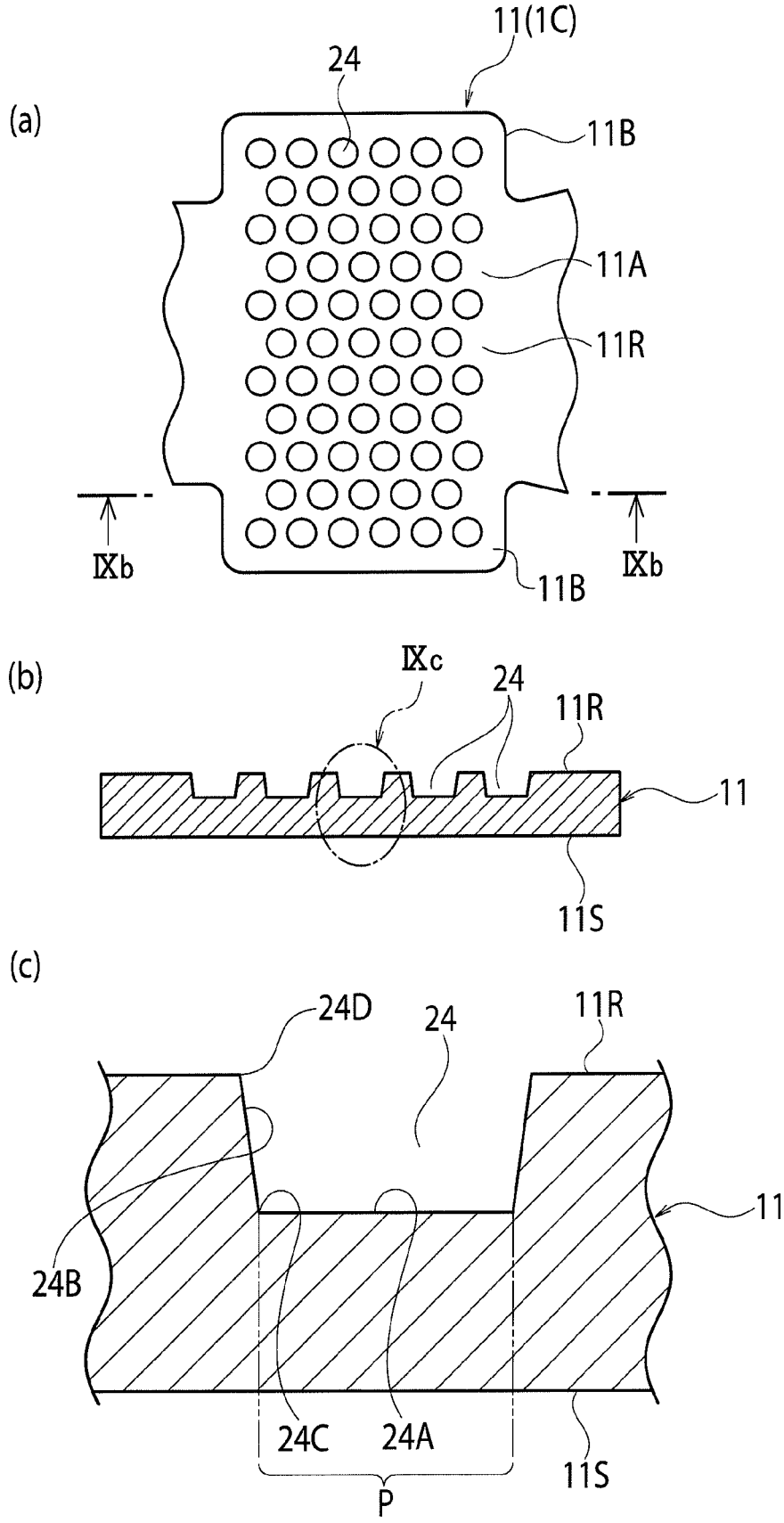
FIG. 9 shows a state before the conductor crimp portion of the crimp terminal is crimped according to a comparative example relative to the embodiments of the present invention, where (a) is a developed plan view, (b) is a cross sectional view taken along the line IXb-IXb in (a), and (c) is an enlarged view of a portion IXc in (b).

FIG. 6 is a perspective view showing an entire structure common to the crimp terminals according to first and second embodiments of the present invention. FIG. 7 shows a state before the conductor crimp portion of the crimp terminal is crimped according to the first embodiment of the present invention, where FIG. 7(*a*) is a developed plan view, FIG. 7(*b*) is a cross sectional view taken along the line VIIb-VIIb in FIG. 7(*a*), and FIG. 7(*c*) is an enlarged view of a portion VIIc in FIG. 7(*b*). FIG. 8 shows a state before the conductor crimp portion of the crimp terminal is crimped according to the second embodiment of the present invention, where FIG. 8(*a*) is a developed plan view, FIG. 8(*b*) is a cross sectional view taken along the line VIIIb-VIIIb in FIG. 8(*b*), and FIG. 8(*c*) is an enlarged view of a portion VIIIc in FIG. 8(*b*). FIG. 9 shows a state before the conductor crimp portion of the crimp terminal is crimped according to a comparative example relative to the embodiments, where FIG. 9(*a*) is a developed plan view, FIG. 9(*b*) is a cross sectional view taken along the line IXb-IXb in FIG. 9(*a*), and FIG. 9(*c*) is an enlarged view of a portion IXc in FIG. 9(*b*).

As shown in FIG. 6, crimp terminals 1, 1B according to the first and second embodiments are each one of a female type and has such a structure as that, in the front portion in the longitudinal direction (also the longitudinal direction of a conductor of an electric wire to be connected, that is, a direction in which the electric wire extends) of the terminal, there is provided a box-type electrical connection portion 10 to be connected to a male terminal on a mating connector side, behind the electrical connection portion 10, there is provided a conductor crimp portion 11 to be crimped to an exposed conductor Wa (refer to FIG. 11) of an end of an electric wire (not shown), and still behind the conductor crimp portion 11, there is provided a coated crimping portion 12 to be crimped to the electric wire's portion coated with an insulative coating. Between the electrical connection portion 10 and the conductor crimp portion 11, there is provided a first connecting portion 13 for connecting the electrical connection portion 10 with the conductor crimp portion 11. Between the conductor crimp portion 11 and the coated crimping portion 12, there is provided a second connecting portion 14 for connecting the conductor crimp portion 11 with the coated crimping portion 12.

The conductor crimp portion 11, which has a bottom plate 11A and a pair of conductor crimping pieces 11B, 11B provided to extend upwardly from right and left side edges of the bottom plate 11A and to be so crimped as to wrap the conductor of the electric wire positioned on an inner surface of the bottom plate 11A, is formed substantially into a U-shape in cross section. The coated crimping portion 12, which has a bottom plate 12A and a pair of coated crimping pieces 12B, 12B provided to extend upwardly from right and left side edges of the bottom plate 12A and so crimped as to wrap an electric wire (a portion with an insulative coating) positioned on an inner surface of the bottom plate 12A, is formed substantially into a U-shape in cross section.

The first connecting portion 13 on the front side of the conductor crimp portion 11 and the second connecting portion 14 on the rear side of the conductor crimp portion 11, which respectively have bottom plates 13A, 14A and low side plates 13B, 14B standing upwardly from right and left side edges of the bottom plates 13A, 14A, are each formed substantially into a U-shape in cross section.

A bottom plate in a range from a bottom plate (not shown) of the electrical connection portion 10 in the front portion to the coated crimping portion 12 in the rearmost portion (the bottom plate 13A of the first connecting portion 13, the bottom plate 11A of the conductor crimp portion 11, the bottom plate 14A of the second connecting portion 14, and the bottom plate 12A of the coated crimping portion 12) is formed continuously in a form of one piece of band plate. The front and rear ends of the low side plate 13B of the first connecting portion 13 are continuous with respective lower half portions at a rear end of a side plate (no reference numeral) of the electrical connection portion 10 and at a front end of the conductor crimping piece 11B of the conductor crimp portion 11, while the front and rear ends of the low side plate 14B of the second connecting portion 14 are continuous with respective lower half portions at a rear end of the conductor crimping piece 11B of the conductor crimp portion 11 and at a front end of the coated crimping piece 12B of the coated crimping portion 12.

As shown in FIG. 7 and FIG. 8, with the conductor crimp portion 11 in a state before being crimped to the conductor of the electric wire, on an inner surface 11R (of the inner surface 11R and an outer surface 11S of the conductor crimp portion 11) on a side contacting the conductor of the electric wire, many small circular recesses 20, 22, as recess-shaped serrations, are so provided as to be scattered about in a zigzag form, in a state of being spaced apart from each other.

With the crimp terminal 1 according to the first embodiment, as shown in FIG. 7, each of the small circular recesses 20 of the inner surface 11R of the conductor crimp portion 11 has a cross section formed into a semicircle, making a hemispherical surface in a range from the inner bottom surface 20A to inner side surface 2B of the recess 20. Thus, a hole edge 20D of the recess 20 serves as a peripheral edge of the hemispherical surface.

With respect to the crimp terminal 1B according to the second embodiment, as shown in FIG. 8, each of the small circular recesses 22 of the inner surface 11R of the conductor crimp portion 11 has a cross section with a lower half thereof being a semicircle and an upper half thereof being a rectangle. That is, the inner bottom surface 22A of the recess 22 is a hemispherical surface and an inner peripheral side surface 22B in a form of a cylindrical surface connects from the hole edge 22D of the recess 22 to a peripheral edge of an inner bottom surface 22A formed as a hemispherical surface.

Then, in each of the crimp terminals 1, 1B, a thinnest portion P of each of the recesses 20, 22 is defined as a central one point of one of the respective inner bottom surfaces 20A, 22A.

On the other hand, with respect to the crimp terminal 1C according to the comparative example, as shown in FIG. 9, each of small circular recesses 24 of the inner surface 11R of the conductor crimp portion 11 has a cross section formed into a rectangle or a reverse trapezium. The inner bottom surface 24A of the recess 24 has a flat surface parallel to the outer surface 11S of the conductor crimp portion 11 and an inner peripheral corner portion 20C where an inner side surface 24B and inner bottom surface 24A of the recess 24 intersect with each other is angular. A hole edge 24D of the recess 24 is also angular. In this case, the thinnest portion P of the recess 24 is defined as a spacious area covering the entirety of the inner bottom surface 20A.

For crimping the conductor crimp portion 11 of each of the crimp terminals 1, 1B, 1C to the conductor of the end of the electric wire, each of the crimp terminals 1, 1B, 1C is placed on a placing surface (upper surface) of a not-shown lower mold (anvil), the conductor of the end of the electric wire is inserted between the conductor crimping pieces 11A of the conductor crimp portion 11, and then the conductor of the end of the electric wire is placed on the upper surface (inner surface 11R) of the bottom plate 11A. Then, lowering the upper mold (crimper) relative to the lower mold allows a guide inclined surface of the upper mold to gradually bring down a distal end side of the conductor crimping piece 11B inwardly.

Then, with the upper mold (crimper) further lowered relative to the lower mold, finally, the distal end of the conductor crimping piece 11B is so rounded, by a curved surface continuous from the guide inclined surface to a central mountainous portion of the upper mold, as to be folded back to the conductor side, and the distal ends of the conductor crimping pieces 11B being frictionally mated with each other are made to eat into the conductor, to thereby crimp the conductor crimping piece 11B in such a manner as to wrap the conductor.

The above operations can connect, by the crimping, the conductor crimp portion 11 of each of the crimp terminals 1, 1B, 1C to the conductor of the electric wire. With respect to the coated crimping portion 12 as well, the lower mold and upper mold are used to gradually bend the coated crimping pieces 12B inwardly, to thereby crimp the coated crimping pieces 12B to the electric wire's portion coated with the insulative coating. By these operations, the crimp terminal 1 can be electrically and mechanically connected to the electric wire.

The crimp terminals 1, 1B according to the respective first and second embodiments can bring about the following effects.

Figure 11:
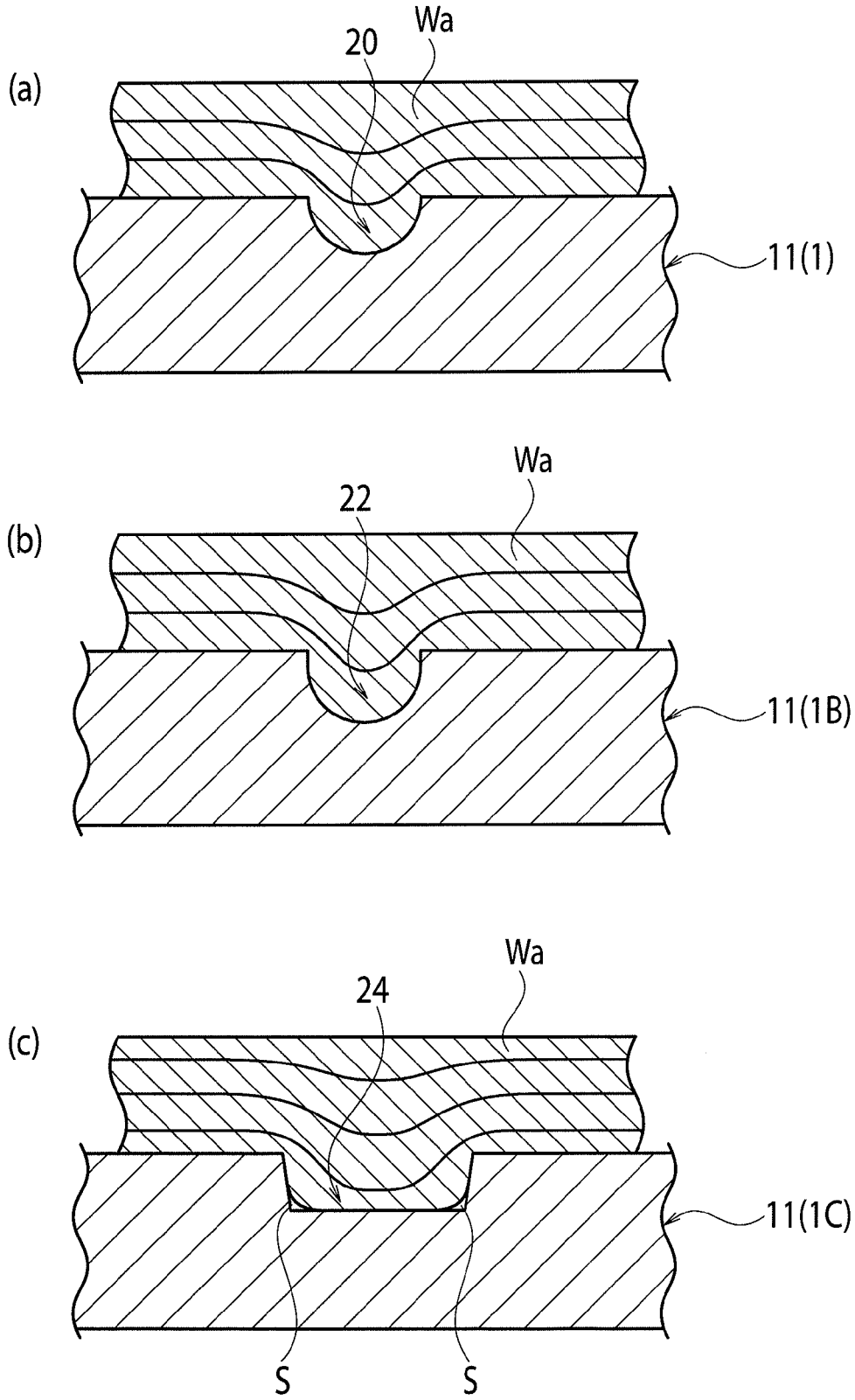
FIG. 11 shows cross sectional views showing a difference of the flowing conductor entering into the small circular recess provided as the serration, where (a) is the case of the first embodiment, (b) is the case of the second embodiment, and (c) is the case of the comparative example.

When the conductor crimp portion 11 is crimped to the conductor of the electric wire by using the crimp terminals 1, 1B, as shown in FIGS. 11(*a*), (*b*), the conductor Wa of the electric wire, while causing a plastic deformation, enters into each of the small circular recesses 20, 22 provided, as the serrations, at the inner surface of the conductor crimp portion 11, to thereby strengthen the joint between the terminals 1, 1B and the conductor Wa. In this case, the surface of the conductor caused to flow by a pressing force has a frictional mating with hole edges 20D, 22D of the respective recesses 20, 22 or the surface of the conductor entering into each of the recesses 20, 22 causes a frictional mating with the inner side surfaces 20B, 22B of the respective recesses 20, 22, thereby an oxide film of the surface of the conductor Wa is peeled off and a newly formed surface exposed has a contact conduction with the crimp terminals 1, 1B.

Especially, since many small circular recesses 20, 22 are provided, as serrations, at the crimp terminals 1, 1B, irrespective of the extending direction of the conductor Wa, a total length of the hole edges 20D, 22D of the respective recesses 20, 22 brings about an effectiveness in scraping off the oxide film. Thus, the contact conduction effect by the exposure of the newly formed surface can be more increased than when the linear serration intersecting with the direction in which the conductor of the electric wire extends is provided like the associated example.

Since the inner bottom surfaces 20A, 22A of the small circular recesses 20, 22 each have a hemispherical surface, the inner peripheral corner portion 24C as shown according to the comparative example in FIG. 9(*c*) is eliminated, thus the conductor Wa having entered into the recesses 20, 22 can smoothly flow along the hemispherical surface. Thus, the gap caused to the inner peripheral corner portion of the serration can be reduced or eliminated.

On the other hand, in the case of the crimp terminal 1C according to the comparative example in FIG. 11(*c*), since the inner peripheral corner portion 24C of the small circular recess 24 is angular, a gap S is likely to be caused to the inner peripheral corner portion 24C. Thus, when the gap S is large, the influence of the thermal shock, mechanical vibration or the like makes the oxide film grow with the gap S as a start point, thus causing a fear of lowering the contact conductivity between the conductor Wa and the crimp terminal 1C.

However, in the case of the crimp terminals 1, 1B according to the first and second embodiments, as shown in FIG. 11(*a*) or FIG. 11(*b*), eliminating the inner peripheral corner portion can contribute to reducing the gap, thus enabling to suppress the growth of the oxide film as well as to maintain a good contact conduction performance for a long time.

Figure 10:
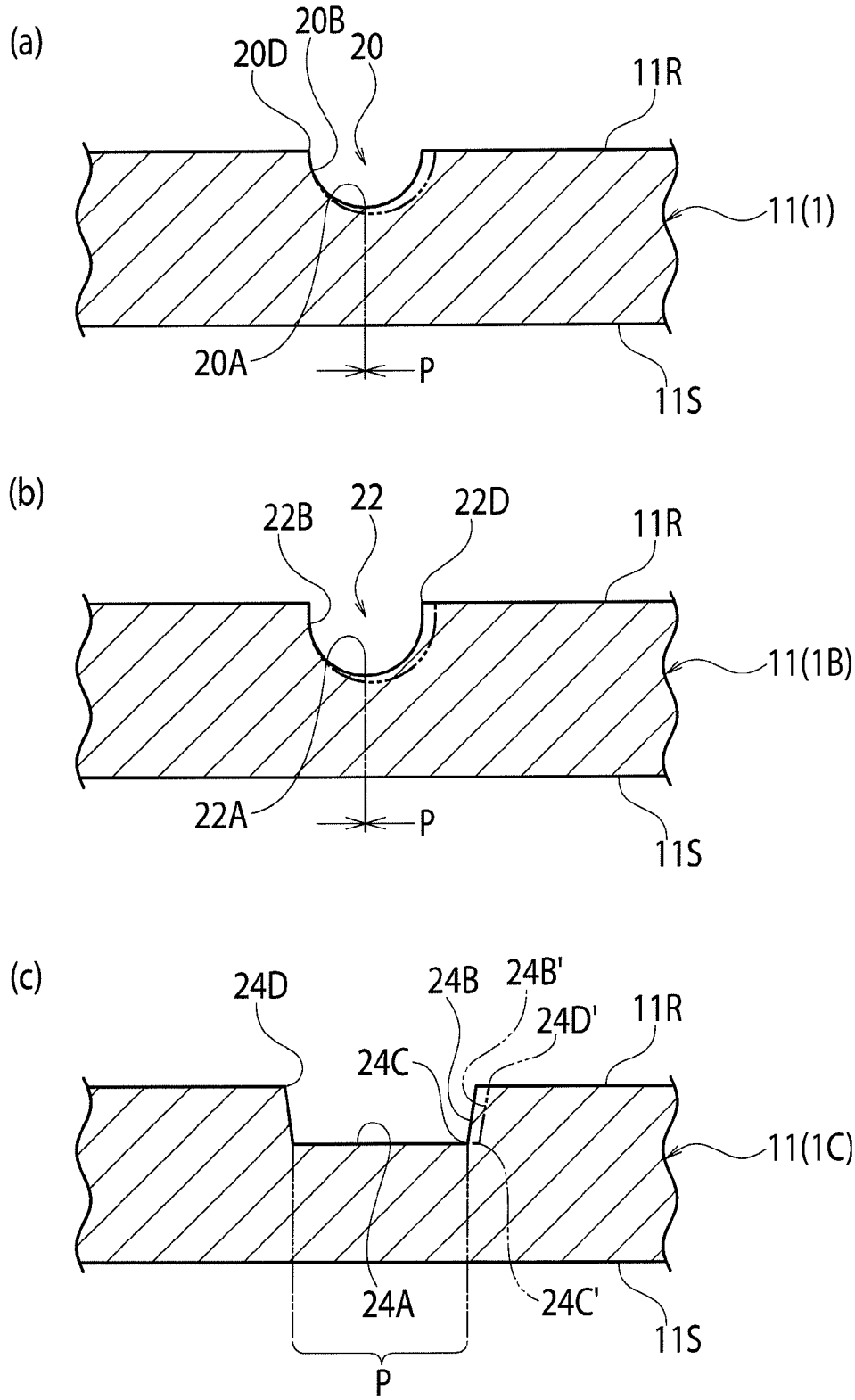
FIG. 10 shows cross sectional views showing a difference of extended deformation by the crimping of the small circular recess provided as a serration, where (a) is the case of the first embodiment, (b) is the case of the second embodiment, and (c) is the case of the comparative example.

As shown in FIGS. 10(*a*), (*b*), with the crimp terminals 1, 1B according to the first and second embodiments, since the inner bottom surfaces 20A, 22A of the recesses 20, 22 each have a hemispherical surface, the thin portion P at the bottom of the recesses 20, 22 can be reduced as much as possible. In this respect, when the inner bottom surface 24A of the recess 24 has a flat surface as is the case of the comparative example in FIG. 10(*c*), the thinnest portion P becomes large by an amount equivalent to an area of the flat surface, thus the inner bottom surface 24A becomes likely to extend accordingly when the press pressure is applied. For example, extension of the inner bottom surface 24A of the recess 24 moves positions of the inner side surface 24B, hole edge 24D and inner peripheral corner portion 24C to 24B', 24D', 24C'.

Contrary to the above movement of positions, in the case of the first embodiment and second embodiment, defining the inner bottom surfaces 20A, 20A of the recesses 20, 22 each as the hemispherical surface allows the thin portion P to be narrowed down to one point in the center portion of the hemispherical surface, thus increasing the rigidity from the inner bottom surfaces 20A, 22A to the inner side surfaces 20B, 22B, to thereby make the bottom of the recesses 20, 22 hardly extendable.

Thus, as shown in FIGS. 11(*a*), (*b*), the relative movement amount between the conductor Wa and the recesses 20, 22 extended according to the press pressure is enlarged and the extension of the conductor Wa entering into the recesses 20, 22 is promoted, the frictional mating between the crimp terminals 1, 1B and the conductor Wa is activated and the peeling of the oxide film of the conductor surface is promoted. Increasing the rigidity from the inner bottom surfaces 20A, 22A to inner side surfaces 20B, 22B of the recesses 20, 22 increases the contact pressure between the recesses 20, 22 (especially, the hole edges 20D, 22D) and the conductor Wa. As a result, the contact conductivity between the conductor Wa and the crimp terminals 1, 1B is improved.

Especially, in the case of the crimp terminal 1B according to the second embodiment, since the inner peripheral side surface 22B in the form of the cylindrical surface is secured for the recess 22, the depth from the hole edge 22D of the recess 22 to the inner bottom surface 22A of the recess 22 is enlarged, thus increasing the uniting strength between the conductor (entering into the recess 22) and the crimp terminal 1B. The contact area between the inner surface of the recess 22 and the conductor Wa is increased, thus further increasing the contact conductivity.

In the crimp terminals 1, 1B, since the inner bottom surfaces 20A, 22A of the recesses 20, 22 each have the hemispherical surface, the stress applied to the distal end of the protrusion portion of the metal mold at the time of the press machining of the recesses 20, 22 can be reduced, thus also bringing about an advantage of improving the wear resistance of the metal mold.

According to the above embodiments, although the crimp terminals 1, 1B each are the female terminal metal fitting having the electrical connection portion 10. However, not limited to female, the crimp terminals 1, 1B each may be a male terminal metal fitting having a male tab or what is called an LA terminal with a through hole formed at the metal plate material. That is, according to necessity, the crimp terminals 1, 1B each may be a crimp terminal having an arbitrary configuration.

As set forth above, the embodiments of the present invention have been explained. However, the present invention is not limited to the above embodiments and therefore various modifications are allowed.

The invention claimed is:

1. A crimp terminal comprising:

an electrical connection portion provided in a front portion in a longitudinal direction of the terminal; and a conductor crimp portion provided behind the electrical connection portion and crimped and connected to a conductor of an end of an electric wire, the conductor crimp portion having a cross section formed into a U-shape by a bottom plate and a pair of conductor crimping pieces provided to extend upwardly from both right and left side edges of the bottom plate and crimped to wrap the conductor disposed on an inner surface of the bottom plate, wherein the conductor crimp portion before being crimped to the conductor of the end of the electric wire includes, in an inner surface of the conductor crimp portion, circular recesses as serrations scattered to be spaced from each other, and wherein the recesses each has an inner bottom surface in a form of a hemispherical surface spaced over substantially an entirety of the central surface of the conductor crimp portion.

2. The crimp terminal according to claim 1, wherein the recesses each has an inner peripheral side surface, in a form of a cylindrical surface, connecting an area from a hole edge of the recess to a peripheral edge of the inner bottom surface in the form of the hemispherical surface.

* * * * *